US005687860A

United States Patent [19]

Behrens et al.

[11] Patent Number: 5,687,860

[45] Date of Patent: Nov. 18, 1997

[54] LONGITUDINALLY ADJUSTABLE COUPLING ROD

[75] Inventors: Hans-Hermann Behrens, Salzgitter; Hubert Rathner; Klaus Ksienzyk, both of Wolfenbüttel; Dieter Schillings, Neuss, all of Germany

[73] Assignee: Scharfenbergkupplung GmbH, Salzgitter, Germany

[21] Appl. No.: 628,583

[22] Filed: Apr. 4, 1996

[30] Foreign Application Priority Data

Apr. 8, 1995 [DE] Germany ..... 195 13 386.2

[51] Int. Cl.[6] ..... B61G 5/00

[52] U.S. Cl. ..... 213/7; 213/4; 213/75 R; 280/482; 280/491.1

[58] Field of Search ..... 213/4, 7, 12, 18, 213/74, 75 R, 104; 280/482, 491.1, 491.3

[56] References Cited

U.S. PATENT DOCUMENTS

| | | | |
|---|---|---|---|
| 522,299 | 7/1894 | Leeds | 213/4 |
| 4,049,129 | 9/1977 | Bergs | 213/4 |
| 4,116,460 | 9/1978 | Drower | 280/491.1 |
| 5,472,104 | 12/1995 | Domsgen | 213/4 |

FOREIGN PATENT DOCUMENTS

| | | | |
|---|---|---|---|
| 103166 | 11/1960 | Denmark | 280/482 |
| 914 980 | 11/1954 | Germany . | |
| 32 13 697 | 4/1990 | Germany . | |
| 43 28 811 | 10/1994 | Germany . | |

*Primary Examiner*—S. Joseph Morano
*Attorney, Agent, or Firm*—McGlew and Tuttle

[57] ABSTRACT

A longitudinally adjustable coupling rod for central buffer couplings of rail-borne vehicles. The coupling rod has a longitudinally adjustable section, which is formed by four shear elements fastened to a support body in an articulated manner. Two shear elements form front shears and two shear elements form rear shears. The two shear elements of the rear shears are associated extensively mirror-symmetrically with the shear elements of the front shears. The shear elements of each of the shears, which are arranged opposite each other, are connected to one another in their front area by hinges.

20 Claims, 2 Drawing Sheets

7
4a
12,12'
8
13
14
17
15,15'
16
4b
6
18

7
5a
11
9,9b
8
19
4a
10
6
1,3
7
5b
14
12,12'
13
5
9,9a
8
4b
4
19
1,2
6
18

LONGITUDINALLY ADJUSTABLE COUPLING ROD

FIELD OF THE INVENTION

The present invention pertains to a longitudinally adjustable coupling rod for central buffer couplings of rail-borne vehicles.

BACKGROUND OF THE INVENTION

In prior-art central buffer couplings, the coupling head extends beyond the vehicle profile on the front side.

Central buffer couplings, whose coupling head and coupling rod can be transferred to behind the front-side vehicle profile when not in use, are used especially for rail-borne vehicles which do not travel on lines of their own, e.g., streetcars, in order to avoid danger to other road users due to the coupling head extending beyond the rail-borne vehicle on the front side.

Central buffer couplings in which the coupling head or the coupling head and part of the coupling rod can be pivoted in the horizontal plane within the front-side clearance profile have been known from U.S. Pat. No. 4,049,129, DE 32 13 697 Al, or DE 43 28 811 CL.

The energy-consuming elements arranged in the coupling rod or on the support are no longer able to function in the pivoted position in the prior-art arrangements. In the case of an impact, the energy of the impact must be absorbed by other assembly units and elements.

Longitudinally adjustable couplings have also been known which can be pushed under the vehicle body in the uncoupled state.

In German Patent No. DE-PS 914 980, a coupling rod with a coupling head, which can be pushed in and out in relation to the superstructure, can be locked in both end positions. To facilitate the pushing in and out as well as the locking of the coupling rod, the coupling rod is provided at its free end with a stop pin led through it and is displaceable in a sleeve, which has two mutually opposite longitudinal slots for guiding the stop pin, which slots are widened at both ends in the manner of a bayonet catch.

In the prior-art couplings that can be pushed in, the coupling rod usually slides in a sleeve, which is located between the articulation point on the vehicle and the end of the car. The overall length of the coupling rod is consequently between the end of the car and the articulation point in the withdrawn position as well, so that the articulation point is located relatively far from the end of the vehicle. Since a large range of pivoting of the coupling rod must be provided for for travel in sharp curves, a large space is lost at the end of the car for accommodating other assembly units in the case of a long coupling rod. The space is not available for the installation of an adjusting device of such a design especially in the case of low-platform vehicles.

SUMMARY AND OBJECTS OF THE INVENTION

The primary object of the present invention is therefore to provide a longitudinally adjustable coupling rod, which requires a small installation depth and maintains energy-consuming elements installed in the coupling rod in a ready-to-operate state even in the pushed-in position.

According to the invention, a longitudinally adjustable coupling rod is provided for rail-borne vehicles for central buffer couplings of the rail-borne vehicles. The coupling rod is provided with a longitudinally adjustable section which is formed by four shear elements fastened to a support body in an articulated manner. Two of the shear elements form front shears and two of the shear elements form rear shears. The two shear elements of the rear shears are associated with shear elements of the front shears in an essentially mirror-symmetrical manner. The shear elements of each of the shears arranged opposite each other are connected to one another in their front area by means of a hinge.

The plane of pivoting of the shears is preferably directed in a horizontal plane in parallel to a plane of the chassis of the rail-borne vehicle.

At least one locking device is preferably associated with the shear elements.

The hinges connecting the opposite shear elements are preferably arranged in an extended position (over stretched position) of the shears, next to the plane formed by their respective articulation on the support body, offset in a direction of the central longitudinal axis of the coupling rod. With this arrangement, the shears are disposed in a position above the top dead center in the extended position.

The shear elements of the front shears are preferably supported on the support surfaces on the front support in the extended position (position above the top dead center).

The locking device preferably has a fixed locking claw which is arranged on a shear element of the shears. A locking device also preferably has a displaceable or pivotable locking bar, which is arranged on the shear element of the shears arranged on the other side of the central longitudinal axis of the coupling rod.

An actuating lever for pivoting the shears, which acts on the rear shears via the actuating levers, is arranged on the coupling rod. The actuating device is preferably designed as an actuating carriage with a linear guide. The actuating device preferably is driven by a steering device which also actuates the locking device. The steering device is preferably designed as a steering carriage with linear guide. An electric, pneumatic or hydraulic drive is also preferably associated with the steering device. The steering device is preferably driven by means of a lifting spindle drive. The actuating device is preferably driven, in time, after the steering device.

The shear elements are preferably formed by U-shaped sections. A shock-absorbing device is preferably arranged between the coupling head and the longitudinally adjustable section of the coupling rod.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
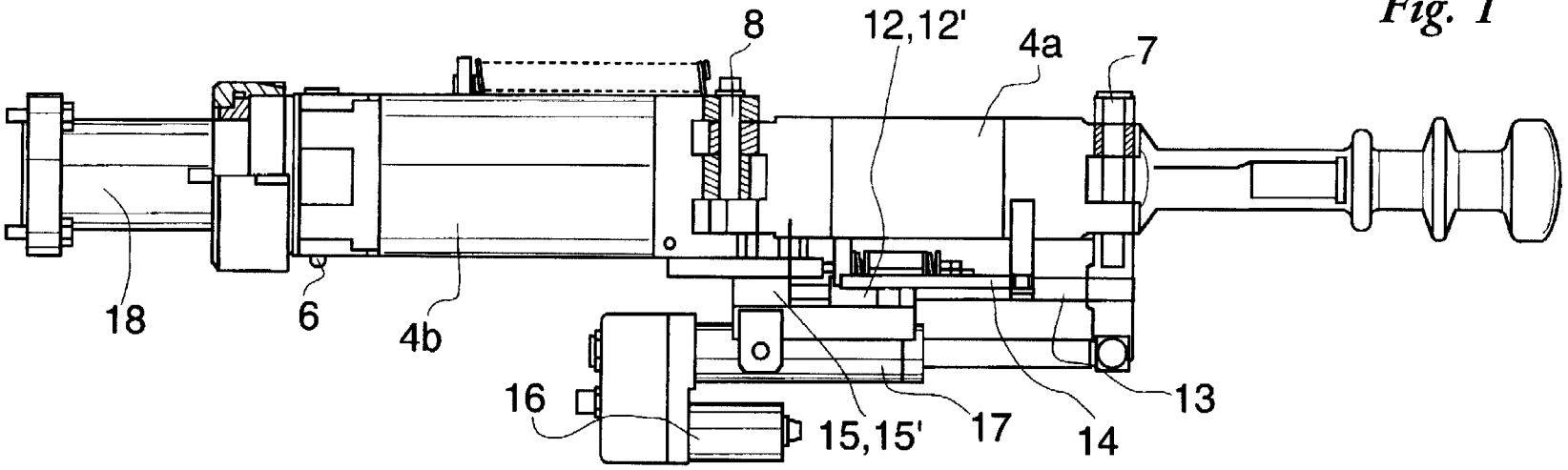
FIG. 1 is a partially cut-away side view of a coupling rod according to the present invention.
Figure 2:
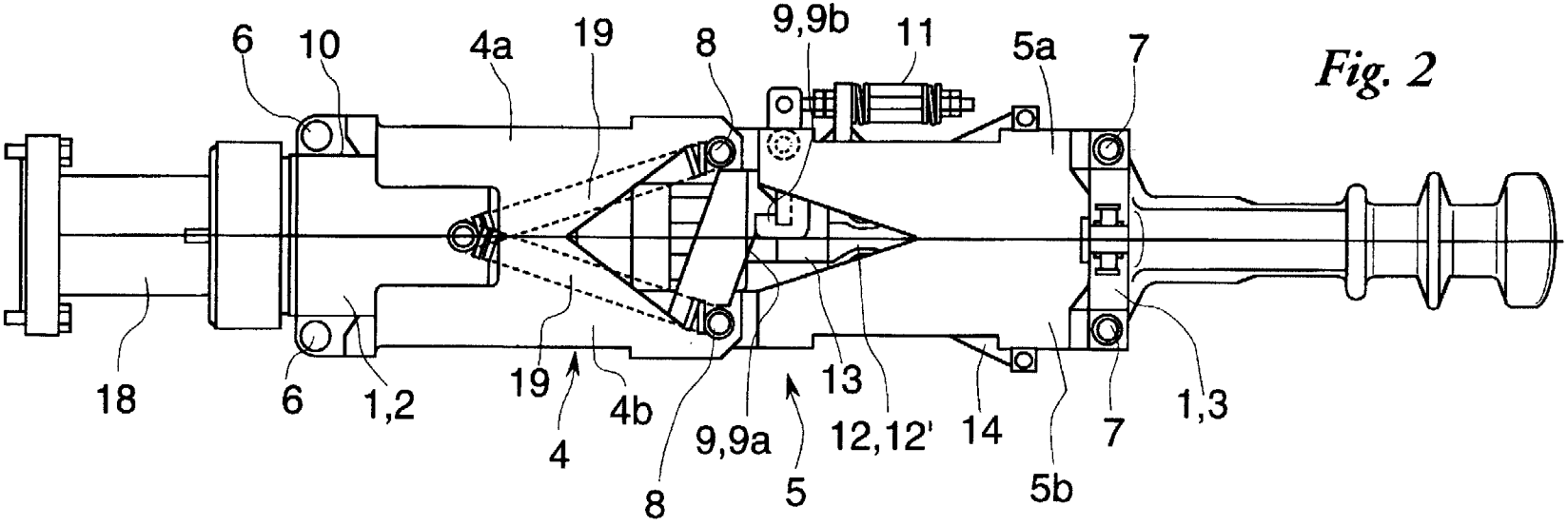
FIG. 2 is a top view of the coupling rod according to FIG. 1.
Figure 3:
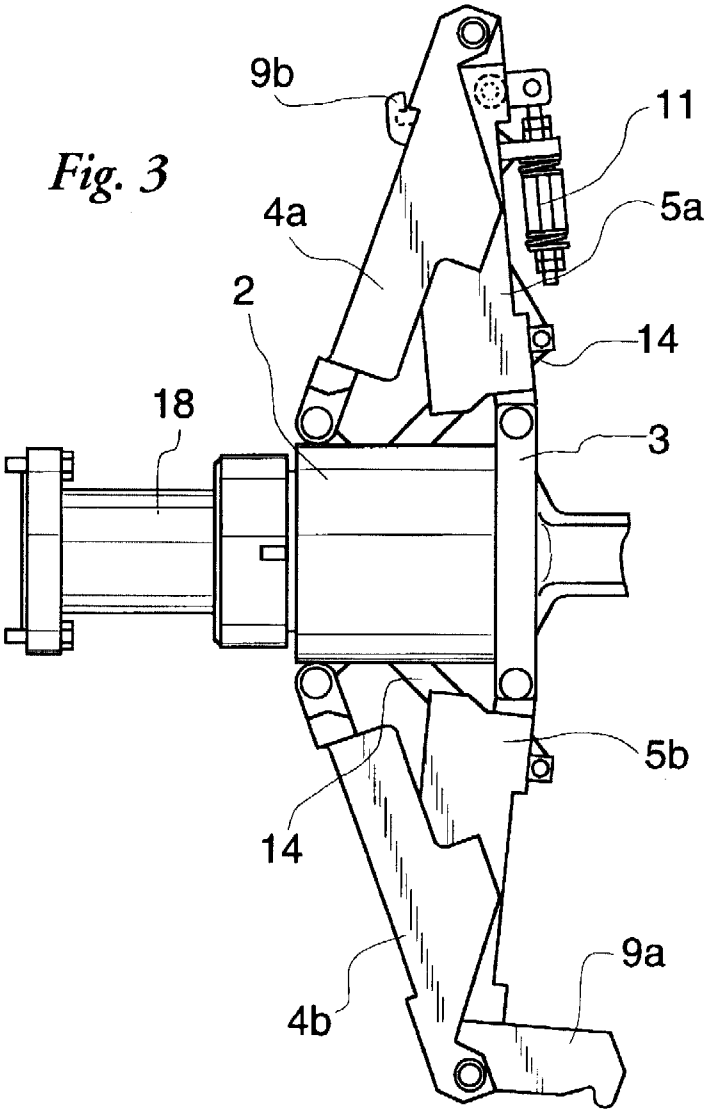
FIG. 3 is a top view of a coupling rod according to FIG. 2 in the withdrawn position.

The coupling rod shown in FIGS. 1 through 3 has a support body 1 with a front support 2 and a rear support 3.

A longitudinally adjustable section is arranged between the supports 2 and 3. The longitudinally adjustable section is formed by two shears 4 and 5 arranged opposite each other.

The front shears 4 are formed by a left-hand shear element 4*a* and a right-hand shear element 4*b*, wherein the shear elements 4*a* and 4*b* are linked to the front support 2 by means of hinges 6 in a plane at right angles to the central longitudinal axis of the coupling rod at the same level.

The rear shears 5 are formed by a left-hand shear element 5*a* and a right-hand shear element 5*b*, wherein the shear elements 5*a* and 5*b* are linked to the rear support 3 by means of hinges 7 in a plane at right angles to the central longitudinal axis of the coupling rod at the same level.

The shear elements 4*a*, 4*b* of the front shears 4 are associated with the shear elements 5*a* and 5*b* of the rear shears 5 extensively mirror-symmetrically, and the shear elements 4*a* and 5*a* of the respective shears 4 and 5 and the shear elements 4*a* and 5*b* of the respective shears 4 and 5, which are arranged opposite each other, are connected to one another in their front area by means of a hinge 8.

The pivot axes of the hinges 6, 7 and 8 are directed vertically, so that the plane of pivoting of the shears 4 and 5 is directed horizontally and in parallel to the plane of the chassis of the rail-borne vehicle after attachment of the coupling rod to a rail-borne vehicle. At least one locking device 9 is associated with the shear elements 4*a*, 4*b*, 5*a*, and 5*b*. The shears 4, 5 are prevented by the locking device 9 from spreading under tensile load. In the extended position, the hinges 8 connecting the opposite shear elements 4*a* and 5*a*, on the one hand, and 4*b* and 5*b*, on the other hand, are arranged next to the plane formed by their corresponding linkage on the front support 2, in the hinge 6, and the rear support 3, in the hinge 7, offset in the direction of the central longitudinal axis of the coupling rod. Due to this arrangement of the hinges 6, 7, 8, the shears 4, 5 are arranged in the extended position in a position above the top dead center under pressure load.

In the overstretched position (position above the top dead center), the shear elements 4*a*, 4*b* of the front shear are supported on the support surfaces 10 on the front support 2, as a result of which the shears 4 and the articulated shears 5 are prevented from buckling.

The locking device 9 has a fixed locking claw 9*a*, which is arranged on a shear element 4*b* of the shears 4, and a locking bar 9*b*, which can be displaced or pivoted against the force of a spring and is arranged on a shear element 5*a* of the shears 5 arranged on the other side of the central longitudinal axis of the coupling rod and can be snapped into the fixed locking claw 9*a* in the closed position.

An actuating device 12 for pivoting the shears 4, 5, which acts on the rear shears 5 via actuating levers 14 on the shear elements 5*a*, 5*b* in an articulated manner, is also arranged on the coupling rod. The actuating device 12 is designed as an actuating carriage 12' with linear guide of the actuating carriage 12, by means of a guide rod 13.

The actuating device 12 is in functional connection with a steering device 15, which in turn actuates the locking device 9.

The steering device 15 is designed as a steering carriage 15', with a linear guide and is preferably driven by means of an electric drive 16.

Pneumatic or hydraulic drives, which are selected depending on expedience and the available source of energy, are also suitable for use as drives 16.

The actuating device 12 is driven and actuated in time after the steering device 15, i.e., there is an idle stroke of the steering carriage, 15'. The actuating device 12 which first unlocks the locking device 9 and displaces coming into contact with the actuating carriage 12'.

The steering device 15 is driven by a lifting spindle drive 17.

The shear elements 4*a*, 4*b*, 5*a*, 5*b* are preferably designed as U-shaped sections.

A shock-absorbing device 18, e.g., a regenerative elastomer cartridge, is arranged at the front support 2 between the longitudinally adjustable section of the coupling rod and the coupling head (not shown).

The front shear elements 4*a*, 4*b* are spring-loaded against spreading by means of tension springs 19, which are attached to the hinge 8, on the one hand, and to the front support 2, on the other hand.

To withdraw the coupling rod, the lifting spindle 17 is driven via the drive 16.

The lifting spindle 17 drives the steering carriage 15' and displaces same in the direction of the rear support 3. The steering carriage 15' now pivots the locking bar 9*b* against the force of the spring 11 and disengages it from the locking claw 9*a*. After complete unlocking, the steering carriage 15' comes into contact with the actuating carriage 12' on its way in the direction of the rear support 3 and displaces same on the guide rod 13 in the direction of the rear support 3. The actuating levers 14 linked to the actuating carriage 12' apply a compressive force on the shear elements 5*a*, 5*b* in terms of spreading of the shears 5. Due to the spreading of the shears 5, the shears 4 are also spread against the force of the springs 19 due to the connection with the shears 4 via the hinges 8, and a longitudinal adjustment of the coupling rod in terms of a shortening takes place.

The dimensions of the elements of the coupling rod, especially of the shear elements 4*a*, 4*b*, 5*a*, 5*b* are selected to be such that in the withdrawn position, the coupling head is brought behind the front-side vehicle profile. The opening in the front-side cover in the coupling area of the vehicle can then be covered by means of a suitable apron or a cover part, and cover parts which can be inserted, pivoted in or displaced and are stationarily arranged on the vehicle as a rule, have been known.

The shock-absorbing device 18 and possibly additional shock-absorbing devices of the chassis-side articulation remain fully functionally connected in the coupling rod between the coupling head and the rear support 3 in the withdrawn position as well.

To extend the coupling rod, the lifting spindle 17 is driven in the opposite direction via the drive 16. The lifting spindle drive 16 drives the steering carriage 15' and displaces same in the direction of the front support 2. After an idle stroke, the steering carriage 15' comes into contact with the actuating carriage 12' on its way in the direction of the front support 2, and displaces same in the same direction. The actuating levers 14 linked to the actuating carriage 12' apply a tensile force on the shear elements 5*a*, 5*b* in terms of closing the shears 5. The shears 4 are pivoted together as in the process in which the coupling rod is withdrawn. When the overstretched position (extended position) is reached, the movable locking bar 9*b* rotates behind the fixed locking claw 9*a* against the force of the spring 11 and secures the coupling rod against spreading of the shears 4, 5 under tensile load.

While a specific embodiment of the invention has been shown and described in detail to illustrate the application of the principles of the invention, it will be understood that the invention may be embodied otherwise without departing from such principles.

What is claimed is:

1. A longitudinally adjustable coupling rod for rail-borne vehicles for central buffer couplings of rail-borne vehicles, comprising:

a support body including a front support and a rear support;

a longitudinally adjustable section including only four shear elements, two of said shear elements forming front shears articulated to said front support, said front support extending a distance between said front shears and two of said shear elements forming rear shears articulated to said rear support, wherein said two shear elements of the said rear shears are associated with said two shear elements of said front shears to provide an essentially mirror-symmetrical arrangement; and a hinge pivotably connecting one of said front shears to one of said rear shears; and another hinge pivotably connecting another of said front shears to another of said rear shears, said front shears and said rear shears being movable between a retracted position wherein said front support is adjacent to said rear support and an extended position wherein said front support is spaced a distance from said rear support, said another of said front shears and said another of said rear shears extending end to end in a line in said extended position and said one of said front shears and said one of said rear shears extending end to end in a line in said extended position whereby said extended position forms a more highly loadable position.

2. A longitudinally adjustable coupling rod in accordance with claim 1, wherein a plane of pivoting of the said shears is horizontal.

3. A longitudinally adjustable coupling rod in accordance with claim 1, further comprising a locking device associated with the said shear elements for locking said shear elements in said extended position for loading said shear elements in said extended position.

4. A longitudinally adjustable coupling rod in accordance with claim 1 wherein said hinges connecting said shear elements are arranged, in an extended position of said shears, adjacent to a plane formed by their respective articulation on said support body, offset in a direction of a central longitudinal axis of the coupling rod, such that said shears are arranged in a position above a extended position.

5. A longitudinally adjustable coupling rod in accordance with claim 1, wherein said shear elements of the said front shears are supported on support surfaces on said front support in an extended position, above a top dead center.

6. A longitudinally adjustable coupling rod in accordance with claim 3, wherein said locking device has a fixed locking claw, which is arranged on a shear element of said shear elements, and has one of a displaceable and pivotable locking bar, which is arranged on another shear element of said shear elements, arranged on the other side of a central longitudinal axis of said coupling rod.

7. A longitudinally adjustable coupling rod in accordance with 1, further comprising an actuating device for pivoting said shears, said actuating device acting on said rear shears via actuating levers and being arranged on said coupling rod.

8. A longitudinally adjustable coupling rod in accordance with claim 7, wherein said actuating device includes an actuating carriage with linear guide.

9. A longitudinally adjustable coupling rod in accordance with claim 7, further comprising a locking device associated with the said shear elements, and a steering device driving said actuating device, said steering device also actuating said locking device.

10. A longitudinally adjustable coupling rod in accordance with claim 9, wherein said steering device includes a steering carriage with linear guide.

11. A longitudinally adjustable coupling rod in accordance with claim 9, further comprising one of an electric, pneumatic, and hydraulic drive associated with said steering device.

12. A longitudinally adjustable coupling rod in accordance with claim 9, further comprising a spindle drive driving said steering device.

13. A longitudinally adjustable coupling rod in accordance with claim 7, wherein said actuating device is driven in time after a steering device.

14. A longitudinally adjustable coupling rod in accordance with claim 1, wherein said shear elements are formed by U-shaped sections.

15. A longitudinally adjustable coupling rod in accordance with claim 1, further comprising a shock-absorbing device connected to said longitudinally adjustable section of the said coupling rod.

16. A longitudinally adjustable coupling rod for rail-borne vehicles for central buffer couplings of rail-borne vehicles, comprising:

a support body including a front support and a rear support;

a longitudinally adjustable section including four shear elements, two of said shear elements forming front shears articulated to said front support and two of said shear elements forming rear shears articulated to said rear support, wherein said two shear elements of the said rear shears are associated w/th said two shear elements of said front shears to provide an essentially mirror-symmetrical arrangement;

a hinge pivotably connecting one of said front shears to one of said rear shears;

another hinge pivotably connecting another of said front shears to another of said rear shears; and a locking device associated with the said shear elements, said locking device has a fixed locking claw, which is arranged on a shear element of said shear elements, and has one of a displaceable and pivotable locking bar, which is arranged on another shear element of said shear elements, arranged on the other side of a central longitudinal axis of said coupling rod.

17. A longitudinally adjustable coupling rod for rail-borne vehicles for central buffer couplings of rail-borne vehicles, comprising:

a support body including a front support and a rear support;

a longitudinally adjustable section including four shear elements, two of said shear elements forming front shears articulated to said front support and two of said shear elements forming rear shears articulated to said rear support, wherein said two shear elements of the said rear shears are associated with said two shear elements of said front shears to provide an essentially mirror-symmetrical arrangement;

a hinge pivotably connecting one of said front shears to one of said rear shears;

another hinge pivotably connecting another of said front shears to another of said rear shears;

an actuating device for pivoting said shears, said actuating device acting on said rear shears via actuating levers and being arranged on the coupling rod, said actuating device including an actuating carriage with a linear guide.

18. A longitudinally adjustable coupling rod in accordance with claim 17, further comprising a locking device associated with the said shear elements, and a steering device driving said actuating device, said steering device also actuating said locking device.

19. A longitudinally adjustable coupling rod in accordance with claim 18, wherein said steering device includes a steering carriage with linear guide.

20. A longitudinally adjustable coupling rod in accordance with claim 18, further comprising a spindle drive driving said steering device.

* * * * *